US009143854B2

(12) United States Patent
Alao

(10) Patent No.: US 9,143,854 B2
(45) Date of Patent: Sep. 22, 2015

(54) WIRELESS HEADBAND AUDIO PLAYER

(71) Applicant: Emmanuel Adedolapo Alao, Annadale, VA (US)

(72) Inventor: Emmanuel Adedolapo Alao, Annadale, VA (US)

( * ) Notice: Subject to any disclaimer, the term of this patent is extended or adjusted under 35 U.S.C. 154(b) by 96 days.

(21) Appl. No.: 13/986,378

(22) Filed: Apr. 25, 2013

(65) Prior Publication Data

US 2014/0321661 A1 Oct. 30, 2014

(51) Int. Cl.

| | |
|---|---|
| ***H04R 25/00*** | (2006.01) |
| ***A42C 5/02*** | (2006.01) |
| ***H04R 1/10*** | (2006.01) |
| ***H04R 5/033*** | (2006.01) |

(52) U.S. Cl.

CPC ..... *H04R 1/105* (2013.01); *H04R 5/0335* (2013.01); *A42C 5/02* (2013.01); *H04R 1/1033* (2013.01); *H04R 1/1041* (2013.01); *H04R 1/1058* (2013.01); *H04R 1/1066* (2013.01); *H04R 1/1075* (2013.01); *H04R 2201/103* (2013.01)

(58) Field of Classification Search

CPC ..... H04R 5/0335; H04R 5/033; H04R 1/105; H04R 1/1066; H04R 2201/103; A42C 5/02

USPC ..... 381/74, 333, 367, 376, 379, 380, 381, 381/383, 366, 374, 364; 2/171.5, 171, 172, 2/181, 181.2, 181.4, 182.4, 183

See application file for complete search history.

(56) References Cited

U.S. PATENT DOCUMENTS

| | | | | |
|---|---|---|---|---|
| 4,499,593 | A * | 2/1985 | Antle | 381/378 |
| 4,525,878 | A | 7/1985 | Lowe, Jr. | |
| 5,881,390 | A * | 3/1999 | Young | 2/209.13 |
| 6,301,367 | B1 | 10/2001 | Boyden et al. | |
| 6,888,950 | B2 | 5/2005 | Siskin et al. | |
| 7,310,427 | B2 | 12/2007 | Retchin et al. | |
| 7,313,246 | B2 * | 12/2007 | Miller et al. | 381/381 |
| 7,409,064 | B2 | 8/2008 | Watanuki | |
| 7,974,432 | B1 | 7/2011 | Ryan | |
| 8,009,847 | B2 | 8/2011 | Planansky | |
| 2003/0091209 | A1 * | 5/2003 | Ito et al. | 381/379 |
| 2005/0123151 | A1 * | 6/2005 | Whipple | 381/103 |
| 2006/0185062 | A1 | 8/2006 | Peng et al. | |
| 2006/0251277 | A1 | 11/2006 | Cho | |
| 2008/0044052 | A1 * | 2/2008 | Whipple | 381/376 |
| 2008/0144872 | A1 * | 6/2008 | Phillips | 381/333 |
| 2008/0181429 | A1 * | 7/2008 | Fried | 381/87 |
| 2008/0216211 | A1 | 9/2008 | Dolby | |
| 2008/0279403 | A1 * | 11/2008 | Pedersen et al. | 381/311 |
| 2008/0295224 | A1 | 12/2008 | Mintzer | |
| 2009/0180658 | A1 | 7/2009 | Dolberg | |
| 2009/0268921 | A1 | 10/2009 | Tang | |
| 2011/0170702 | A1 * | 7/2011 | Bays | 381/74 |

(Continued)

FOREIGN PATENT DOCUMENTS

| | | | |
|---|---|---|---|
| DE | 3538594 | A1 * | 5/1987 |
| EP | 1701582 | A1 | 9/2006 |

(Continued)

*Primary Examiner* — John Villecco

(57) ABSTRACT

Example embodiments provide a headgear including an audio player. The headgear includes a slap-on-band configured to coil around a head of a user, having an elongated state and a coiled state, and the slap-on-band being covered by a fabric cover. The headgear further includes an audio player disposed on the slap-on-band, and a pair of earphones electrically connected to the audio player to generate sound.

11 Claims, 6 Drawing Sheets

(56) References Cited

U.S. PATENT DOCUMENTS

| | | | | |
|---|---|---|---|---|
| 2011/0219522 | A1 | 9/2011 | Petitt | |
| 2011/0252540 | A1 | 10/2011 | Higgins et al. | |
| 2013/0039524 | A1* | 2/2013 | Jones | 381/378 |
| 2013/0044215 | A1* | 2/2013 | Rothkopf et al. | 348/143 |
| 2013/0243236 | A1* | 9/2013 | Chamness et al. | 381/378 |
| 2014/0247951 | A1* | 9/2014 | Malaviya | 381/74 |
| 2014/0328508 | A1* | 11/2014 | Jacks et al. | 381/376 |

FOREIGN PATENT DOCUMENTS

| | | | |
|---|---|---|---|
| FR | 2670092 | A3 * | 6/1992 |
| KR | 100808734 | B1 | 2/2008 |
| WO | WO 2009/108151 | A1 | 9/2009 |
| WO | WO 2010015030 | A1 * | 2/2010 |

* cited by examiner

WIRELESS HEADBAND AUDIO PLAYER

FIELD OF INVENTION

Example embodiments relate generally to headgear and, more particularly, a headgear having ear piece headphones incorporating an integral audio player (e.g., MP3 player) and/or storage device made up of soft flexible resilient circular headband structure.

BACKGROUND

Conventional music player and storage devices have become increasingly transportable to enable such devices to be carried by user. For increasing convenience particularly when performing vigorous exercise, it is desirable to provide a headset which can be associated with the player device.

More recently, music player and storage devices have been incorporated within the headphones themselves and, in particular in ear pieces of those headphones or headsets. In such situations, the inconvenience of wire or potential breaks in communication with wireless coupling with a player device secured on a strap or in a pocket may occur.

However, there is typically a physical wire connection between the player device and the headset or a wireless connection but this connection is often interrupted or disturbed by loose fitting headphones and external wire connection from the headphones to the MP3 player.

When using a headphone to listen to a radio or MP3 player, the user needs to connect the earphones plug cable to the earphones jack of the radio or MP3 player. The earphones plug cable may hinder the user's movement. One of the benefits with regard to providing an integrated music player and storage device in a headset is to avoid the inconvenience of wires and/or the falling out or shifting of headphones. Such benefits are particularly important when involved in sporting activity such as, running, skiing, exercising, basketball, walking, etc.

Consequently, a need still exist for an innovation which will provide an effective solution to the aforementioned problem in the prior art without introducing any new problems in place thereof.

SUMMARY

One objective of example embodiments is to provide an audio player with a headband structure which can adapt to different head and ear shapes.

Another objective of example embodiments is to provide an adjustable headband assembly for headphones designed to fit all sizes and shapes of heads and adjustable headphone speakers which cannot become dislodged from the ear canal during recreational or sporting activities such as walking, jogging, hiking, skiing, mountain biking or other similar activities.

Another objective of example embodiments is to provide a headband-headphone assembly that is fashionable and comfortable, offering an effortless control of music, volume and stop/start.

Another objective of example embodiments is to provide an audio player with a soft flexible resilient headband structure which can be either an article of apparel worn on the head of a user as a standalone component or a component of an article of apparel, such as a ballcap, worn on the head of the user.

At least one example embodiment provides a headgear including an audio player, including a slap-on-band configured to coil around a head of a user, and having an elongated state and a coiled state, the slap-on-band being covered by a fabric cover; an audio player disposed on the slap-on-band; and a pair of earphones electrically connected to the audio player to generate sound.

In other example embodiment, the audio player may be built-in within the slap-on-band.

In other example embodiment, the audio player may be removably attachable from the slap-on-band.

In other example embodiment, the pair of earphones may be removably attachable from the slap-on-band.

In other example embodiment, the pair of earphones may be integrated in the slap-on-band.

In other example embodiment, the pair of earphones may extend out from the slap-on-band.

In other example embodiment, the pair of earphones may be adjustable to accommodate the user's ear.

In other example embodiment, the pair of earphones may include grooves to accommodate grooves provided on the slap-on-band for adjustment.

In other example embodiment, the headgear may further include a volume button on the slap-on-band.

In other example embodiment, the volume button may be separately located from the audio player.

In other example embodiment, the fabric cover may be removable from the slap-on-band.

In other example embodiment, the fabric cover may be made from a terry cloth.

In other example embodiment, the terry cloth may be water repellant or waterproof material.

In other example embodiment, the terry cloth may include an antimicrobial material.

BRIEF DESCRIPTION OF THE DRAWINGS

The present invention will become more fully understood from the detailed description given herein below and the accompanying drawings, wherein like elements are represented by like reference numerals, which are given by way of illustration only and thus are not limiting of the present invention and wherein.

Figure 1:
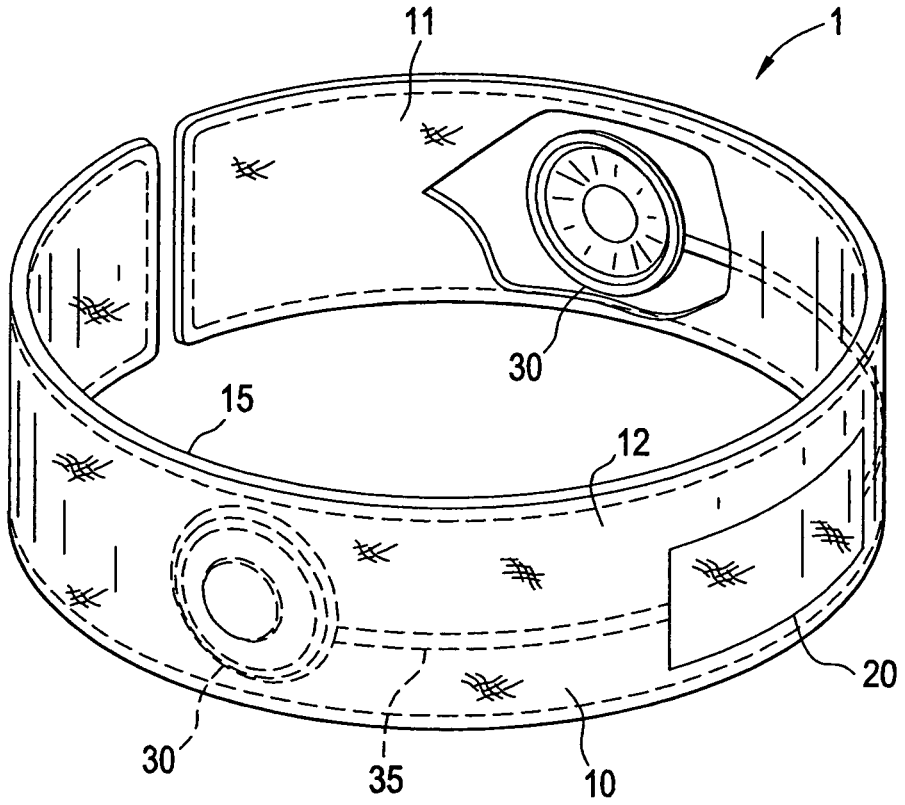
FIG. 1 illustrates a schematic view of a headgear according to an example embodiment.

It should be noted that these Figures are intended to illustrate the general characteristics of methods, structure and/or materials utilized in certain example embodiments and to supplement the written description provided below. These drawings are not, however, to scale and may not precisely reflect the precise structural or performance characteristics of any given embodiment, and should not be interpreted as defining or limiting the range of values or properties encompassed by example embodiments. For example, the relative thicknesses and positioning of molecules, layers, regions and/ or structural elements may be reduced or exaggerated for clarity. The use of similar or identical reference numbers in the various drawings is intended to indicate the presence of a similar or identical element or feature.

DETAILED DESCRIPTION OF EXAMPLE EMBODIMENTS

Various example embodiments will now be described more fully with reference to the accompanying drawings in which some example embodiments are shown. However, specific structural and functional details disclosed herein are merely representative for purposes of describing example embodiments, and thus may be embodied in many alternate forms and should not be construed as limited to only example embodiments set forth herein. Therefore, it should be understood that there is no intent to limit example embodiments to the particular forms disclosed, but on the contrary, example embodiments are to cover all modifications, equivalents, and alternatives falling within the scope of the disclosure.

In the drawings, the thicknesses of layers and regions may be exaggerated for clarity, and like numbers refer to like elements throughout the description of the figures.

Although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that, if an element is referred to as being "connected" or "coupled" to another element, it can be directly connected, or coupled, to the other element or intervening elements may be present. In contrast, if an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," if used herein, specify the presence of stated features, integers, steps, operations, elements and/or components, but do not preclude the presence or addition of one or more other features, integers, steps, operations, elements, components and/or groups thereof.

Spatially relative terms (e.g., "beneath," "below," "lower," "above," "upper" and the like) may be used herein for ease of description to describe one element or a relationship between a feature and another element or feature as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, for example, the term "below" can encompass both an orientation that is above, as well as, below. The device may be otherwise oriented (rotated 90 degrees or viewed or referenced at other orientations) and the spatially relative descriptors used herein should be interpreted accordingly.

Example embodiments are described herein with reference to cross-sectional illustrations that are schematic illustrations of idealized embodiments (and intermediate structures). As such, variations from the shapes of the illustrations as a result, for example, of manufacturing techniques and/or tolerances, may be expected. Thus, example embodiments should not be construed as limited to the particular shapes of regions illustrated herein but may include deviations in shapes that result, for example, from manufacturing.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 illustrates a schematic view of a headgear 1 according to an example embodiment. The headgear 1 may include a slap-on-band 10 configured to coil around a head of a user. The slap-on-band 10 may be in an elongated state or a coiled state. The slap-on-band 10 may further include an audio player 20 disposed thereon and a pair of earphones 30 electrically connected to the audio player 20 to generate sound.

Figure 2:
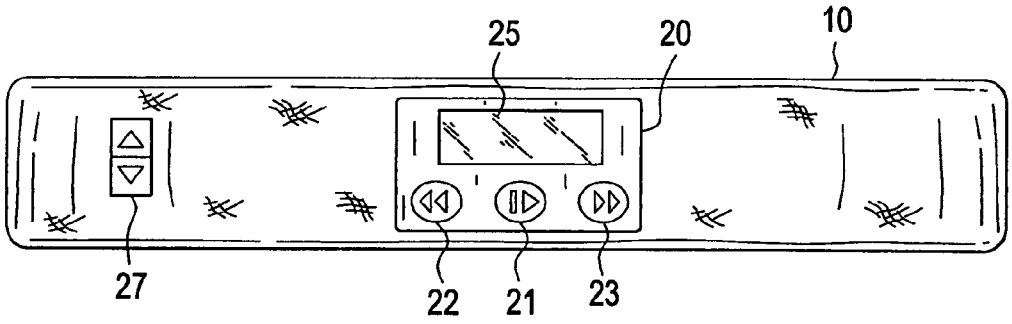
FIG. 2 illustrates a front view of FIG. 1 according to an example embodiment.
Figure 4A:
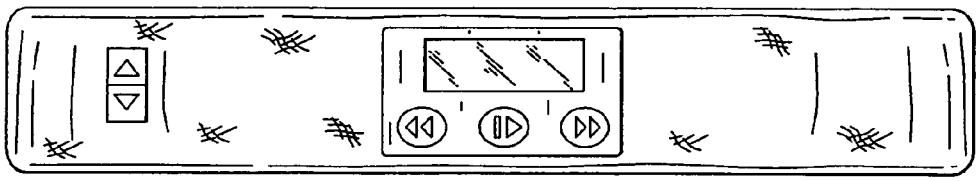
FIG. 4A illustrates a front view of FIG. 2 according to an example embodiment.

The slap-on-band 10 is dimensioned in length to fit around a human's head. For example, the slap-on-band 10 may be approximately 20-24 inches. However, one skilled in the art would appreciate that various other sizes may be used to accommodate the size of a user's head. The slap-on-band 10 may be made of a bistable metal spring body or band. Other materials could be used as alternatives to the metal. The bistable metal spring body is a bistable spring that has two positions of operation or two states. The first state is in the elongated position as shown in FIGS. 2 and 4. In this state, the bistable metal spring body retains potential energy. This potential energy will cause the slap-on-band 10 to coil immediately when the bistable metal body is struck against an object, such as a user's head. The second state is the coiled state, in which the coil state will take place when wrapped around the user's head.

The slap-on-band may preferably be covered with a fabric cover 15, for example, terry cloth or an elastic blend with terry cloth. A terry cloth piece is designed to absorb sweat from a user and to also provide a roughened surface on headgear 1 so that it remains stable on the user's forehead.

One skilled in the art would appreciate that other materials may be used for the fabric cover 15. For example, other material may be at least one of a wicking fabric, a cotton, a wool, a foam, and a thick interface material. Further, the material may be made from a water absorbent, wicking, fast-drying fabric.

The fabric cover 15 may be removable from the slap-on-band 10 for washing or substitution of the headgear 1.

In other example embodiments, the headgear 1 may be advantageously formed and/or fabricated with other additional materials that are, for example, stretchable, water repellant or waterproof material such as mylar, nylon or the like. In some example embodiments, any of these materials may be of a material that is non-irritating to the skin.

In other example embodiments, the headgear 1 may include additional matting or padding in order to provide more durability, comfort, etc.

In other example embodiments, the fabric cover of the headgear 1 may include an antimicrobial and/or deodorizing agents. Examples of the antimicrobial and deodorizing agent may be an inorganic antimicrobial agent such as silver, zirconium, alumino-silicate hydroxyapatite, silica-gel, etc., an organic compound such as a oxybisphenol compound, a titanium dioxide based compound such as a photocatalytic agent from titanium dioxide, a natural compound such as a chitosan acid, amino compound, lysozyme, natural sulfur, tea polyphenol, etc., and the like. In addition, the aromatic may be a natural aromatic such as a herb and a musk, an organic aromatic such as an aromatic compound, and the like.

Referring to FIG. 1, the slap-on-band 10 may include an audio player 20 disposed thereon and a pair of earphones 30 electrically connected to the audio player 20. The audio player 20 may be a MP3 player, for example. One skilled in the art would appreciate that other types of audio players may be used, such as, a radio, a mini-disc player, a portable media player, a tape recorder, etc.

The slap-on-band 10 includes a first side surface 11 configured for opposing the head of a wearer when the headgear 1 is worn on a human head. The slap-on-band 10 also includes a second side surface 12 disposed on a side opposite to the first side surface 11 and opposing the interior surface of the slap-on-band 10.

On the second side surface 12, the audio player 20 may be integrated within the slap-on-band 10. In other words, the audio player 20 is built-in with the slap-on-band on the second side surface 12 (or front side). Further, the fabric cover 15 will cover the entire slap-on-band 10 except the area where the audio player 20 is located.

In other example embodiment, the audio player 20 may be detachable from the slap-on-band 10. It should be appreciated that the audio player 20 may be detached from the slap-on-band 10 by employing various means, such as, for example, glue, adhesive, screws, mechanical fasteners, VELCRO shook-and-loop type fasteners), etc.

Referring to FIG. 2, the audio player 20 may include various function buttons 21-23. Button 21 may be a play and stop button, button 22 may be a rewind button, and button 23 may be a forward button. One skilled in the art would appreciate that other buttons may be employed to perform other functions. The audio player 20 may further include a display screen 25 for displaying various presentations, for example, artist's name, song, album cover, and so forth.

In an alternative embodiment, the audio player 20 may be covered with a plastic film to protect the audio player 20 from damage, (e.g., user's fingers, spillage, sweat, water, etc.).

In an example embodiment, the headgear 1 may include a volume button 27. The volume button 27 may be a button built-in in the audio player 20, or more preferably, the volume button 27 may be separate from the audio player 20. The volume button 27 may be a two-button configuration having an increase volume control and a decrease volume control. Alternatively, the volume button 27 may be controlled using a circular button (i.e., moving in a clockwise direction for increase volume and moving counter clockwise direction for decrease volume).

Referring back to FIG. 1, the pair of earphones 30 may be integrated with the slap-on-band 10. In other words, the pair of earphones 30 is inside of the fabric cover 15. The pair of earphones 30 is electrically connected to the audio player 20 via a wire 35. In this manner, the audio player 20, the pair of earphones 30, and wire 35 are entirely without wiring outside the headgear 1. The advantage is that there are no wires running from the audio player 20 and the ear phones 30 exposed from the outside of the headgear 1, which may get entangled during use of the headgear 1.

Figure 3:
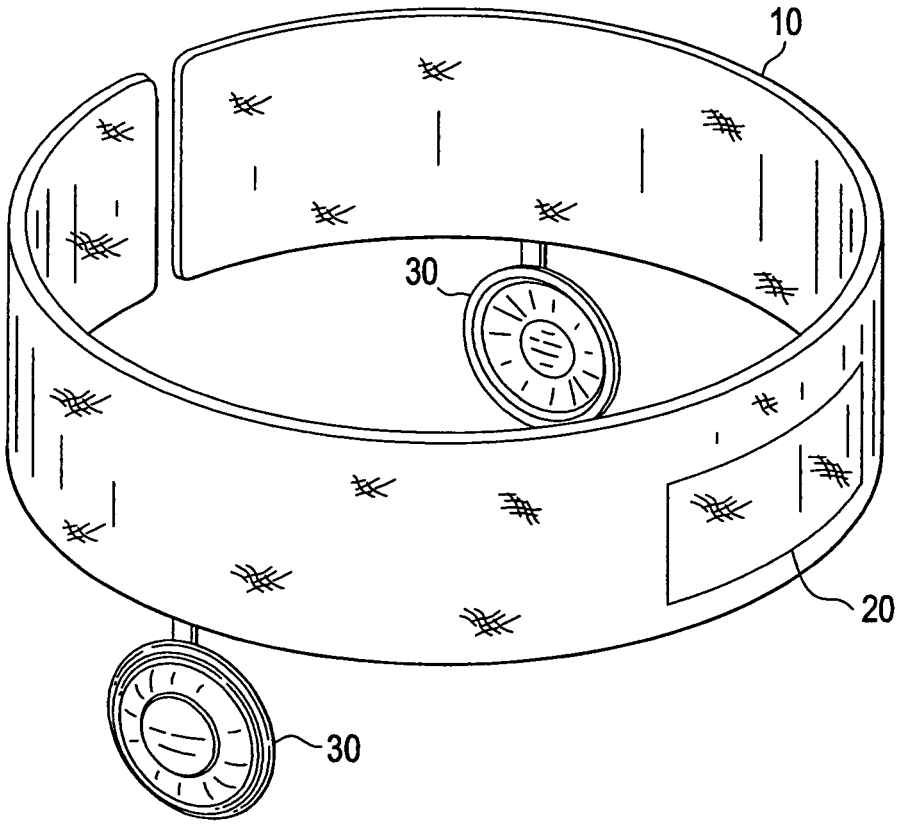
FIG. 3 is a schematic view of a headgear according to another example embodiment.

FIG. 3 is a schematic view of a headgear according to another example embodiment. The headgear 1 of FIG. 3 is similar to the headgear 1 of FIG. 1 except for the pair of earphones 30 extending out from the slap-on-band 10. More specifically, the pair of earphones 30 extends below the slap-on-band 10 to fit over the user's ear. The headgear 1 is preferably sized and shaped so that it resides over a forehead of the user and generally below a hairline above eyes of the user, while the earphones fit into the respective ears.

Figure 4B:
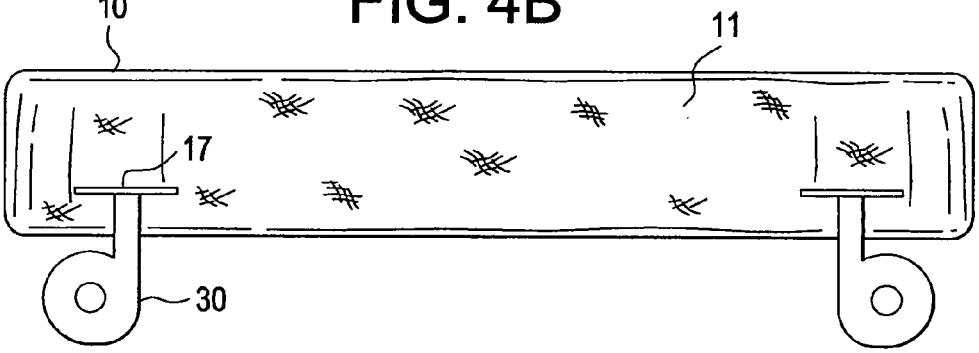
FIG. 4B illustrates a back view of FIG. 2 according to an example embodiment.

As shown in FIG. 4B, the first side surface 11 of the fabric cover 15 includes slits 17. The slits 17 provide openings for the earphones 30 to extend therefrom.

Figure 4C:
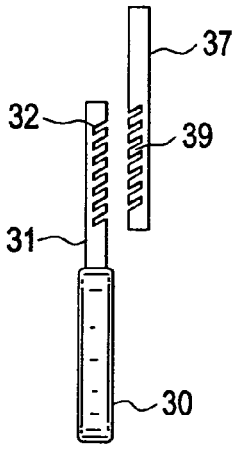
FIG. 4C illustrates the adjustability feature of the earphones according to an example embodiment.

Referring to FIG. 4C, the earphone 30 may be adjustable to fit the various size of the user's head. The earphone 30 includes a support 31 for supporting the earphone 30. At an upper end of the support 31 includes grooves 32 for adjusting the earphone 30. The grooves 32 may be at an angle, preferably, at 45 degrees angle. Similarly, a portion 37 of the slap-on-band 10 also includes grooves 39 which correspond to the grooves 32 provided on the support 31 of the earphone 30. The user may adjust the earphone 30 via an action of an upward force or a downward force.

Figure 5:
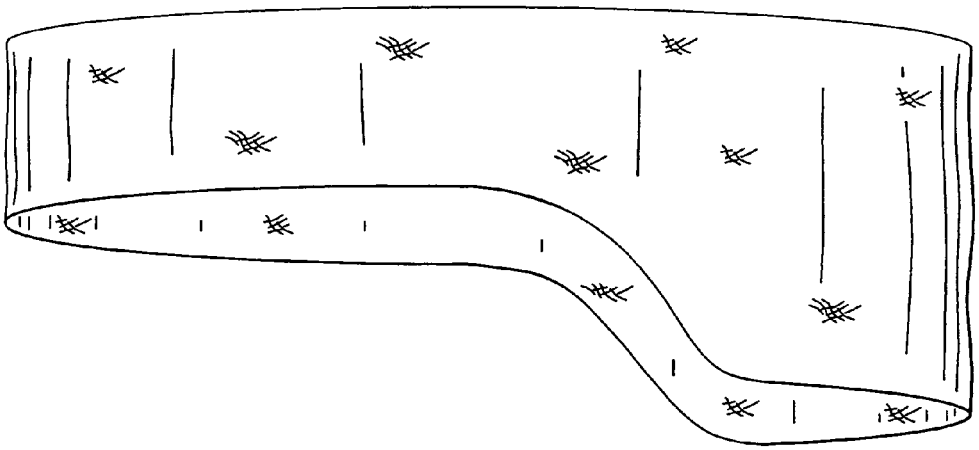
FIG. 5 illustrates a schematic view of a headgear according to another example embodiment.

FIG. 5 illustrates a schematic view of a headgear according to another example embodiment.

Figure 6:
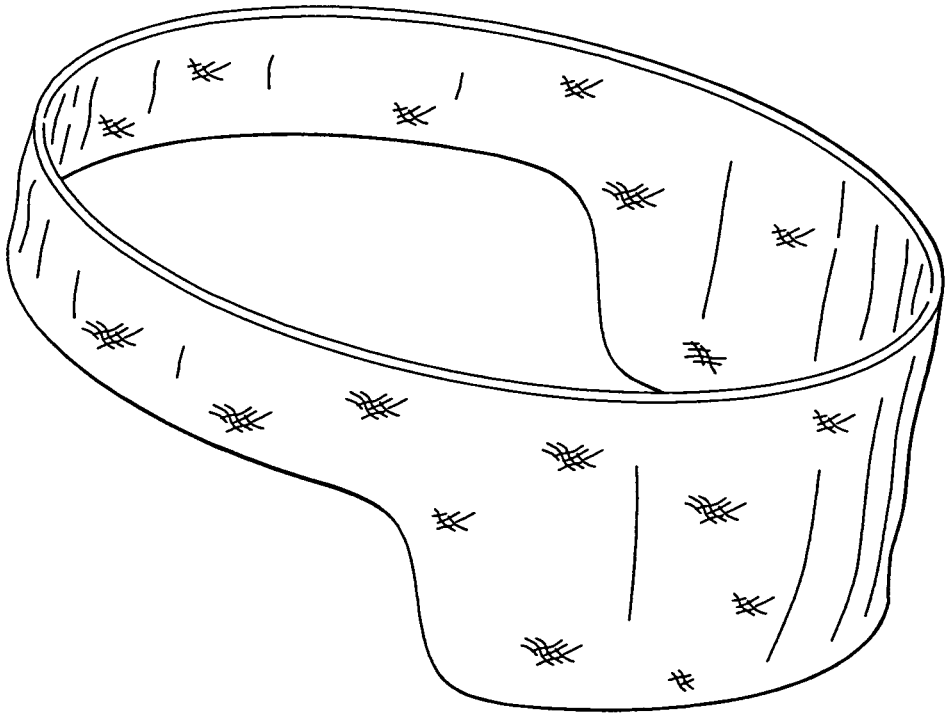
FIG. 6 illustrates a schematic view of a headgear according to another example embodiment.

FIG. 6 illustrates a schematic view of a headgear according to another example embodiment.

The following discussion and associated figures describe the headgear 1 as having the form of a headgear. The concepts and features of the headgear 1 may be applied to a wide variety of headwear types. Examples of such headwear types include baseball caps (full-back and open-back), visors, knitted hats, etc.

The foregoing description of example embodiments has been provided for purposes of illustration and description. It is not intended to be exhaustive or to limit the disclosure. Individual elements or features of a particular example embodiment are generally not limited to that example embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

We claim:

1. A headgear including an audio player, comprising:

a slap-on-band configured to coil around a head of a user, and having an elongated state and a coiled state, the slap-on-band includes a first end and a second end such that, in the coiled state, the first and second ends approach each other as close as possible, creating a space, without the ends touching each other;

an audio player disposed on the slap-on-band and covered by a transparent window sheet; and a pair of earphones electrically connected to the audio player to generate sound, the pair of earphone includes a support having a plurality of grooves, the plurality of grooves of the earphone cooperatively engage with a plurality of corresponding grooves on a portion of the slap-on-band, wherein the plurality of grooves of the earphone and the portion of the slap-on-band are arranged at 45 degrees angles to cooperatively engage with each other and for adjusting a height of the earphone to accommodate the user's ear, and wherein the slap-on-band is covered with a removable fabric cover, the fabric cover includes a slit opening such that the earphone extends out from the slit opening.

2. The headgear according to claim 1, wherein the audio player is built-in within the slap-on-band.

3. The headgear according to claim 1, wherein the audio player is removably attachable from the slap-on-band.

4. The headgear according to claim 1, wherein the pair of earphones is removably attachable from the slap-on-band.

5. The headgear according to claim 1, wherein the pair of earphones is integrated in the slap-on-band.

6. The headgear according to claim 1, wherein the pair of earphones extends out from the slap-on-band.

7. The headgear according to claim 1, further comprising a volume button on the slap-on-band.

8. The headgear according to claim 7, wherein the volume button is separately located from the audio player.

9. The headgear according to claim 1, wherein the fabric cover is made from a terry cloth.

10. The headgear according to claim 1, wherein the fabric cover is water repellant or waterproof material.

11. The headgear according to claim 10, wherein the fabric cover includes an antimicrobial material.

* * * * *